US007023350B2

(12) United States Patent
Sanchez et al.

(10) Patent No.: US 7,023,350 B2
(45) Date of Patent: Apr. 4, 2006

(54) PERSONAL PROTECTION DEVICE

(76) Inventors: Eliezer Sanchez, 30270 SW. 162nd Ave., Homestead, FL (US) 33033; Daisy Sanchez, 30270 SW. 162nd Ave., Homestead, FL (US) 33033

( * ) Notice: Subject to any disclaimer, the term of this patent is extended or adjusted under 35 U.S.C. 154(b) by 0 days.

(21) Appl. No.: 10/625,807

(22) Filed: Jul. 23, 2003

(65) Prior Publication Data

US 2004/0119594 A1 Jun. 24, 2004

Related U.S. Application Data

(60) Provisional application No. 60/399,321, filed on Jul. 23, 2002.

(51) Int. Cl.
*G08B 23/00* (2006.01)

(52) U.S. Cl. ..... 340/573.1; 340/573.3; 340/539.15; 340/539.21; 340/539.23

(58) Field of Classification Search ..... 340/568, 340/572.1, 573.4, 539.21, 539.5, 539.23, 340/651, 565, 567
See application file for complete search history.

(56) References Cited

U.S. PATENT DOCUMENTS

| | | | | |
|---|---|---|---|---|
| 4,593,273 | A | 6/1986 | Narcisse | |
| 4,675,656 | A | 6/1987 | Narcisse | |
| 4,785,291 | A | 11/1988 | Hawthorne | |
| 5,289,163 | A | 2/1994 | Perez | |
| 5,995,007 | A * | 11/1999 | Borja et al. | 340/573.4 |

* cited by examiner

*Primary Examiner*—Julie Bichngoc Lieu
(74) *Attorney, Agent, or Firm*—David P. Lhota, Esq.; Stearns Weaver Miller Weissler Alhadeff & Sitterson P.A.

(57) ABSTRACT

An electronic personal monitoring device that informs the user, i.e. tutor or guardian, when an unauthorized person has come too close to the protected person, i.e. target person, or when the target person moves or has been moved outside a calculated tutor monitoring range wherein the device continually monitors, i.e. self-monitoring, so long as the alarm system is enabled and produces an alarm signal when triggered, which may be a silent or vibration alarm, audible alarm or visual alarm.

9 Claims, 3 Drawing Sheets

PERSONAL PROTECTION DEVICE

CROSS REFERENCE TO RELATED APPLICATIONS

This application claims the benefit of provisional patent application Ser. No. 60/399,321 filed Jul. 23, 2002.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a tracking device, and more particularly, to a device that triggers an alarm when a target person being monitored moves outside a predetermined range or when an unauthorized individual breaches that range. The invention is intended to prevent minors from being lost or kidnapped.

2. Description of the Background Art

It is well known that there is an epidemic problem today of people, especially minors, becoming missing, either by kidnapping or becoming lost. In many instances, minors could be protected from kidnapping or becoming lost if a cognizant individual were warned in a timely manner that the target minor moved outside a designated range or that an unauthorized individual came within a designated range of the target minor. Certain attempts have been made to develop reliable personal monitoring devices that address the foregoing issues. However, they have been unreliable or too expensive or complicated to mass-produce.

For instance, U.S. Pat. Nos. 4,593,273 and 4,675,656, issued to Narcisse, disclose an out-of-range personnel monitor and alarm that may be used by a convalescent home or the like to alert an attendant in the home that a supervised person has walked beyond a predetermined prescribed distance. The system discloses a base unit that transmits a signal to a mobile unit carried by the supervised person. The system includes an adjustable threshold circuit that produces a threshold signal whenever the signal received falls below the threshold. In response to the threshold output signal, a transmitter in the mobile unit produces an output signal to a receiver in the base, which in turn sounds an alarm. U.S. Pat. No. 4,785,291, issued to Hawthorne, discloses a distance monitor especially for child surveillance including an unmodulated radio frequency transmitter carried by a person to be monitored and receiver/monitor apparatus at a monitoring location for providing quantized visual and audible indicia based on received signal strength. The response levels are a function of the distance from the transmitter and receiver. Movement beyond a predetermined range is immediately detected and circuitry is provided to preset the maximum allowable range before an alarm is instituted. U.S. Pat. No. 5,289,163, issued to Perez, discloses a child position monitoring and locating device that monitors the position of a child by detecting signal strength of a radio frequency carrier from a transmitter attached to the child. When the signal is too weak, an adult is notified that the child is too far away by an audio tone or vibrations. The device has a locating display for indicating the child's relative position. U.S. Pat. No. 5,995,007, issued to Borja, discloses a monitoring system in a portable module including radio devices and an indicator for providing an indication upon the radio devices being separated by a predetermined amount.

Although the above noted art discloses various personal monitoring devices, they fail to adequately track missing persons, as contemplated by the instant invention. The instant invention addresses this unfulfilled need in the prior art by providing a personal monitoring device and system that tracks the movement of a predetermined target and provides warning signals when that target bypasses a predetermined perimeter.

BRIEF SUMMARY OF THE INVENTION

In light of the foregoing, it is an object of the present invention to provide a personal monitoring device that actuates an alarm when a pre-identified person comes within a predetermined distance of a predetermined target.

It is another object of the instant invention to provide a personal monitoring device that actuates a distinguishable alarm when a targeted person exceeds a predetermined distance outside a threshold perimeter.

It is a further object of the instant invention to provide a personal monitoring device that can set, regulate and, or change a predetermined threshold perimeter.

It is an additional object of the instant invention to provide a personal monitoring device that is self monitoring.

In light of these and other objects, the instant invention comprises an electronic personal monitoring device that informs the user, i.e. tutor or guardian, when an unauthorized person has come too close to the protected person, i.e. target person, or when the target person moves or has been moved outside a calculated tutor monitoring range. The instant invention is designed to prevent and, or reduce kidnapping and, or targeted persons from getting lost. The personal protection device may also be designed to activate an alarm when detecting other abnormal situations. The device continually monitors, i.e. self-monitoring, so long as the alarm system is enabled. The device produces an alarm signal when triggered, which may be a silent or vibration alarm, audible alarm or visual alarm. A first alarm is triggered when a pre-identified unauthorized person comes within a predetermined range of the target. The same or another alarm is triggered when the protected target person has been moved away from the calculated tutor distance. The instant invention also allows for the regulation of an operating range of action.

DETAILED DESCRIPTION OF THE INVENTION

With reference to the drawings, FIGS. 1–4 depict the preferred and alternative embodiments of the instant invention which is generally referenced as a personal protection device and, or by numeric character 10. The personal protection device 10 comprises an electronic target tracking system 100 and an electronic tutor monitoring system 200 that collectively informs the user, i.e. tutor or guardian, when an unauthorized person has come too close to the protected person, i.e. target person, or when the target person moves or has been moved outside the calculated tutor monitoring range so as to prevent kidnapping or target persons from getting lost. The personal protection device 10 may also be designed to activate an alarm when detecting other abnormal situations. The device 10 continually monitors, i.e. self-monitoring, so long as the alarm system is enabled. The device 10 produces an alarm signal when triggered, which may be a silent or vibration alarm, audible alarm or visual alarm. The alarm is triggered when the protected target person is approached by an unauthorized person or has been moved away from the calculated tutor distance or range. The device 10 also allows for the regulation of an operating range of action.

Figure 1:
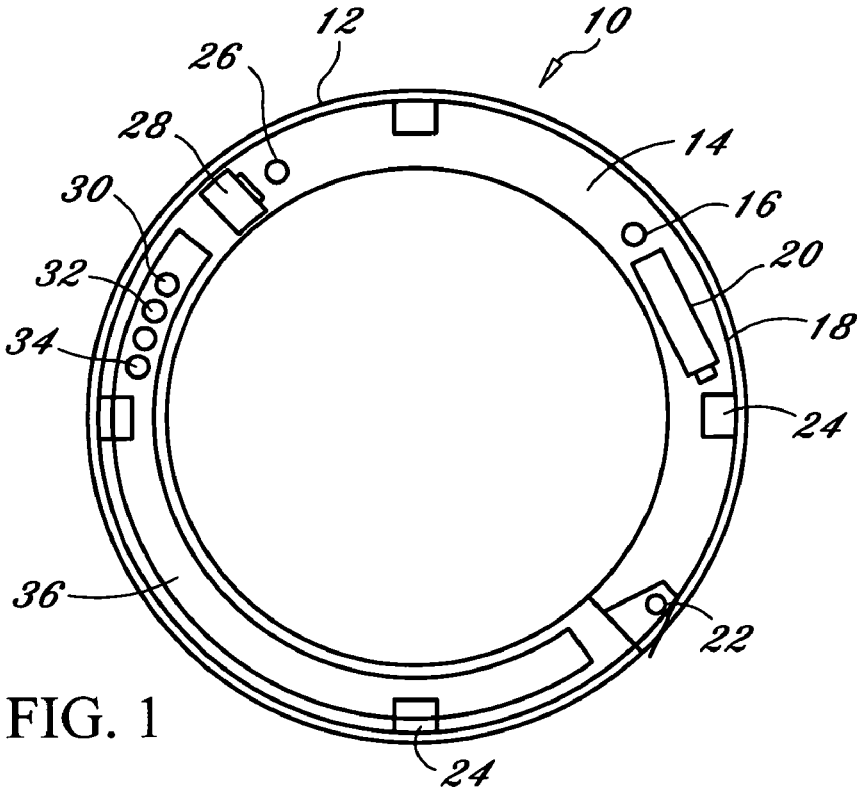
FIG. 1 is a plan view of the preferred embodiment of the target sensor device of the invention in accordance with the instant invention.
Figure 2:
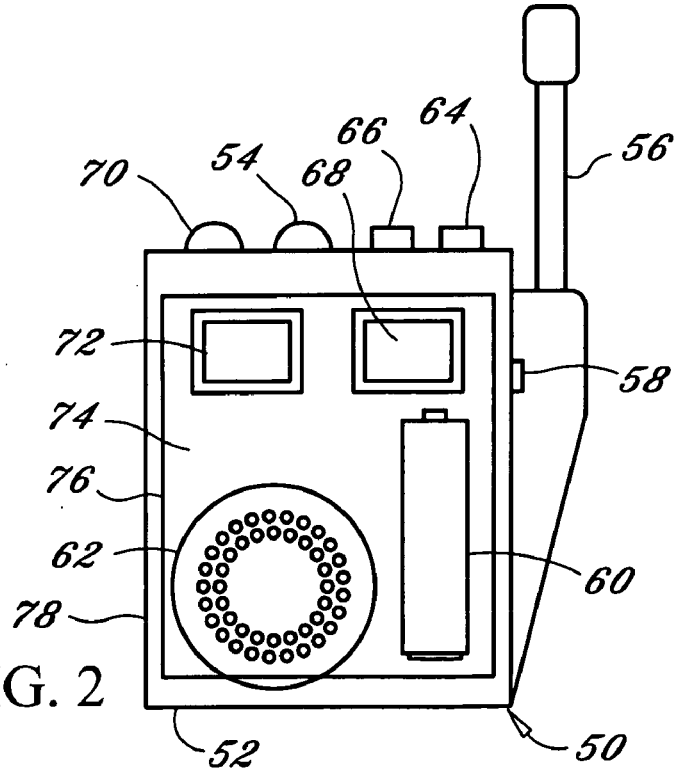
FIG. 2 is an elevational view of the preferred embodiment of the monitor alarm device of the invention in accordance with the instant invention.
Figure 3:
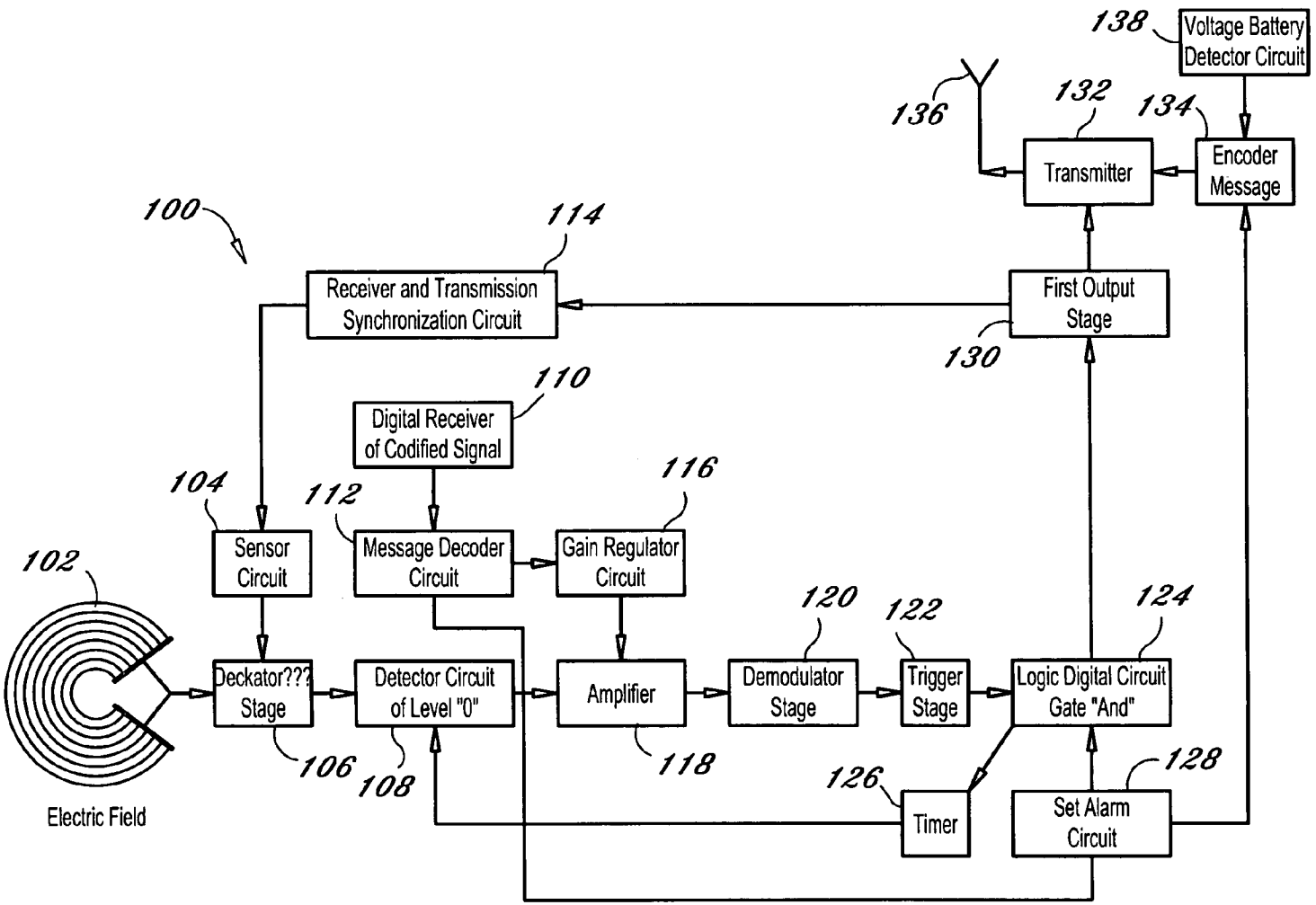
FIG. 3 is a circuit diagram of the target tracking system of the preferred embodiment of the personal protection device in accordance with the instant invention.
Figure 4:
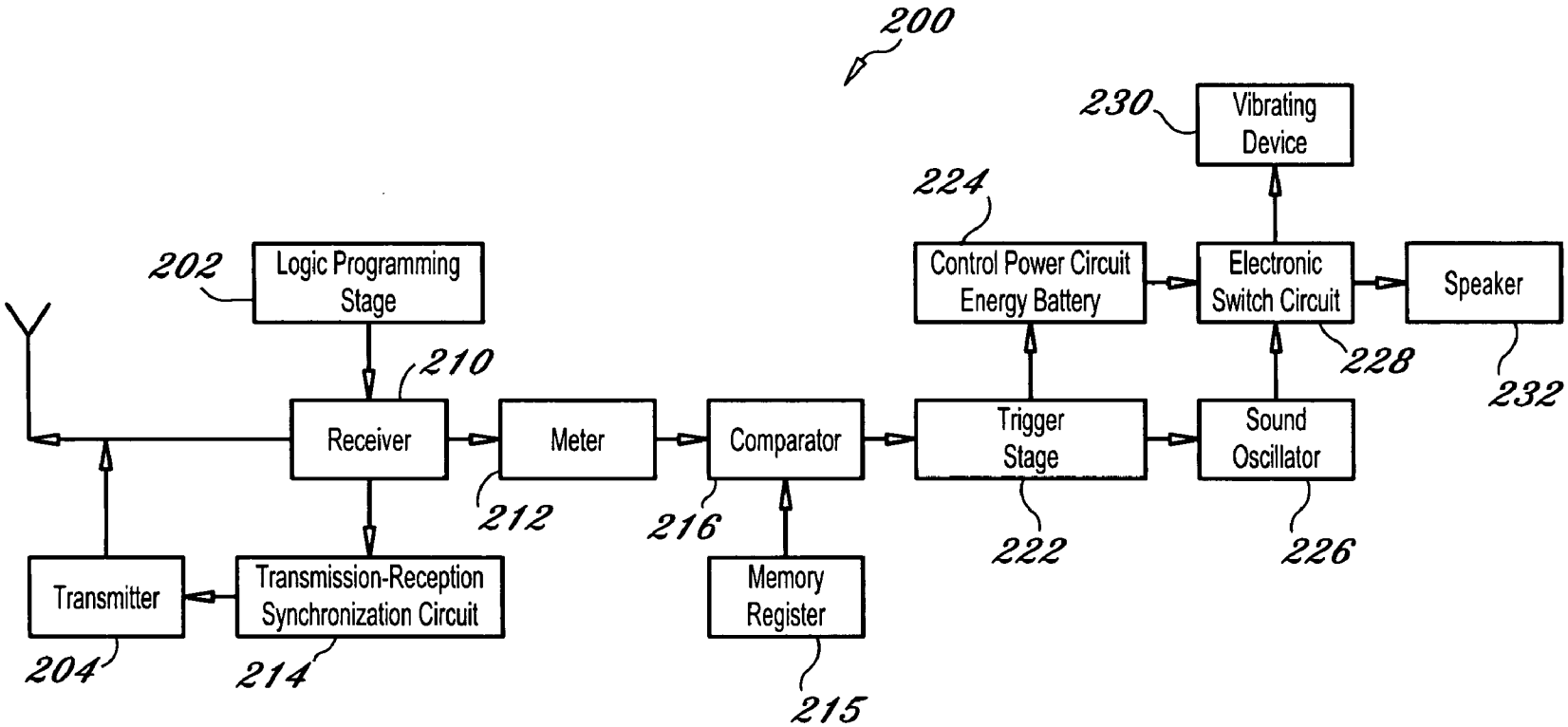
FIG. 4 is a circuit diagram of the tutor monitoring system of the preferred embodiment of the personal protection device in accordance with the instant invention.

With reference to FIGS. 1–4, the personal protection device 10 comprises two main components wherein the first component, i.e. target sensor 12, is affixed to a target person to be monitored and the second component, i.e. monitor 50, is carried by the monitoring person, i.e. tutor or guardian. The circuit 100 of the target sensor 12 is shown in FIG. 3 and the circuit 200 of the monitoring system 50 is shown in FIG. 4. Referring to FIG. 1, the target sensor 12 comprises a transmitter or transceiver-like device that is placed on the target person. The target sensor 12 comprises a body or housing 14, voltage indicator 16, internal antenna 18, battery 20, hinge 22, sensors 24, fastener indicator 26, fastener 28, sensor indicator connection 30, external sensor connection 32, external antenna extension 34, and electronic circuit location 36. The housing 14 is ring-shaped and opens and closes for attaching and removing from a target person. The housing 14 includes a lock for securing it closed. A small-adapted antenna 18, preferably internally disposed, transmits information signals to the monitor 50. A distributed array of sensors 24 sense and, or capture variations in the electric field 102 (shown in FIG. 3), which is present around the target person all the time. The opening and closing of the housing's lock is monitored all the time by the circuit 100, shown in FIG. 3, and enables the alarm system to send a warning signal and, or to ensure proper function of the alarm.

With reference to FIG. 2, the monitor 50 is carried by the guardian or tutor and is a control device comprising a housing 52, alarm enable/disable indicator light 54, antenna 56, output alarm signal switch 58, battery 60, speaker 62, sensibility regulator button 64, button to enable and disable the alarm system 66, control-mode button 68, voltage indicator battery 70, selection mode button 72, digital display 74, electronic location circuit 76, 100, and external connection to hearing aid 78. The monitor 50 enables, disables, and, or calibrates the function of the system 10 and triggers an alarm signal when the sensors detect abnormal variations in the electric field 102, such as when the minor has moved away from the calculated distance by the tutor. The alarm may be audible, visual or based on vibration.

With reference to FIG. 3, the circuitry 100 of the target tracking system of the instant invention comprises a generated electric field 102, sensor circuit 104, oscillator stage 106, detector circuit of level "0", amplifier 118, message decoder circuit 112, digital receiver or codified signal 110, gain regulator circuit 116, demodulator stage 120, trigger to stage 122, logical digital circuit with "And" gate 124, timer 126, set alarm circuit 128, voltage battery detector circuit 138, first output stage 130, encoder message 134, transmitter 132, receiver and transmission synchronization circuit 114, and antenna 136. The circuit 100 receives, processes and transmits signals between the devices 12 and 50 and determines when there has been a disruption in the electric field, such as when the target moves outside the predetermined range or something moves within the range. If the electric field 102 is breached, an alarm signal is generated to activate the alarm.

With reference to FIG. 4, the circuit 200 of the tutor monitoring system 50 comprises a logic programming stage 202, transmitter 204, receiver 210, meter 212, transmission-reception synchronization circuit 214, memory register 215, comparator 216, trigger stage 222, control power circuit energy battery 224, sound oscillator 226, electronic switch circuit 228, vibrating device 230 and speaker 232. The monitoring circuit 200 and device 50 communicates with the target circuit 100 and device 12 and sounds an alarm when an unauthorized person breaches a predetermined threshold approach range of a target person or when a target person moves beyond a second threshold range.

With reference to FIGS. 1–4, the sensors 24 capture variations of the electric field 102 around the target person to determine if there has been a breach of the safety range. The detector circuit 100 and electric field 102 is fixed at level "0" for normal conditions. With reference to FIG. 3, the oscillator 106 in combination with the detector circuit 100 when set at zero establishes resonance for that value only. The demodulator: The oscillating signal is fed into the demodulator section. The demodulator 120 is a filtered rectifier, which converts the AC signal into a DC voltage signal. With respect to the trigger stage 122, the output of the demodulator 120 is connected to a Schmitt trigger 122 input. The Schmitt trigger 122 produces two voltages. If the demodulator 120 decreases to a certain amplitude, it causes the trigger output to quickly change to a low voltage level. When the demodulator 120 increases to a predetermined amplitude, the trigger 122 output quickly changes to its higher voltage level. The output of the trigger stage 122 is inverted to drive the transmitter 132 only when the system is in an abnormal condition (i.e. altered electric field). The logic combinatory circuit is logic digital circuit with an "And" gate 124. The transmitter 132 transmits a signal through the antenna 136 when the signal(s) were processed by the logic circuit 124. The sensibility circuit detector or gain regulation circuit 116 calibrates the amplifier gain. The receiver and transmission synchronization circuit 114 provides a multiplexer for the transmission and reception of data to avoid interference inside the system.

In a first mode, the monitor module 50, 200 sends signal data received to the gain circuit amplifier regulator 116 to calibrate sensibility of the alarm based on variations in the electric field 102. The monitoring device 50 and, or circuits 100, 200 calibrate the power of transmission from the target device 12 to keep and monitor the transmission signal in a preselected radio range of action, as calculated by the tutor. A counter counts the quantity of signals per second received by the transmitter 204 A memory register 215 indicates the rate of signals per second received from the transmitter 204. A comparator 216 compares the rate of signals per second received from the transmitter 204 to information stored in memory 215. If the amount of signal per second received from the transmitter 204 is less than the value stored in memory, the system 10, 50, 200 will activate the alarm. An electronic vibrator switch circuit 228, 230 supplies energy directly from the battery to the silent vibrator circuit when the user selects that option. The amplifier amplifies the sound signal oscillator and sends it to the speaker 232 when activated. The transmission-reception synchronization circuit 214 multiplexes the transmission and reception of data to avoid interference inside the system. Accordingly, the target device 12 and circuit 100 transmits a signal that is monitored in strength and, or frequency by the monitoring device 50 and circuit 200 to determine if a predetermined person comes within a predetermined range of the target device 12 and, or if the target device 12 has traveled outside a predetermined threshold range. If so, the monitoring device 50 and circuit 200 actuates the alarm.

To use the personal protection device 10, the user inserts batteries in each part of the device as indicated on the backside of the device. If after the battery is installed, the battery indicator light is flashing, this indicates that the battery power is low and should be replaced. The battery indicator light 70 should always be monitored. The target sensor 12 ring is placed on the arm or leg of the target person. The target sensor 12 is secured by closing the device 12. The light fastener indicator 26 should illuminate when properly secured on the target person. When pressing the mode button on the monitor 50, the display will show the characters M1. This mode regulates the distance from the unauthorized person to the target person. The sensibility control button 64 is pressed and released next, which causes the display to show the character S1, which means that the sensibility is being regulated in mode 1 for detecting unauthorized person approaching the target person. When pressing the sensibility control button 64 continuously, the display will show different sensibility steps in ½ second to 1 second intervals, until you get the desired sensibility. The button 64 is then released. When pressing the mode button the character M2 will appear on the display. Press and release the sensibility button 64 and on the display will appear S2 characters. Press the sensibility control button 64 continuously and on the display will appear each ½ second to 1 second sensibility steps, until you get the desired sensibility. Press the set button to store information that you enter in memory. Move away from the minor, out of the sensibility range detection sensor that you programmed, but inside the range distance that you programmed from the minor, and set the alarm button to enable the system. To defuse the alarm, press the alarm button again.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An electronic target monitoring system, said system comprising:

a target device adapted for attachment to a target person comprising a target transmission circuit, circuit having sensors that transmit a detectable signal when the target device extends beyond a predetermined first range or when a predetermined device comes within a predetermined second range of said target device; and a monitoring device having a means for determining when said predetermined device comes within said predetermined first range of said target device and when said target device goes beyond said predetermined second range;

said target device comprising:

at least one means for attaching said target device to a person;

antenna for receiving and transmitting signals;

means for monitoring power;

sensor means that detects when said predetermined device comes within said predetermined first range of said target device and when said target device goes beyond said predetermined second range; and means for communicating to said monitoring device when said predetermined device comes within said predetermined first range of said target device and when said target device goes beyond said predetermined second range.

2. A device as recited in claim 1, wherein said target transmission circuit comprises:

means for generating an electric field;

sensor circuit;

oscillator stage;

message decoder circuit;

digital receiver of codified signal;

trigger circuit;

logic digital circuit;

alarm circuit;

output stage; and transmitter.

3. A device as recited in claim 1, wherein said monitor transmission circuit comprises:

a receiver for receiving electric field related signals generated and transmitted by said target device;

transmission-reception synchronization circuit;

comparator circuit;

trigger circuit;

electronic switch circuit; and alarm circuit.

4. An electronic target monitoring system, said system comprising:

a target device adapted for attachment to a target person comprising a target transmission circuit, circuit having sensors that transmit a detectable signal when the target device extends beyond a predetermined first range or when a predetermined device comes within a predetermined second range of said target device;

said target transmission circuit comprising means for generating an electric field, sensor circuit, oscillator stage, message decoder circuit, digital receiver of codified signal, trigger circuit, logic digital circuit, alarm circuit, output stage and transmitter; and a monitoring device having a means for determining when said predetermined device comes within said predetermined first range of said target device and when said target device goes beyond said predetermined second range.

5. A device as recited in claim 4, wherein said target device comprises:

at least one means for attaching said target device to a person;

antenna for receiving and transmitting signals;

means for monitoring power;

sensor means that detects when said predetermined device comes within said predetermined first range of said target device and when said target device goes beyond said predetermined second range; and means for communicating to said monitoring device when said predetermined device comes within said predetermined first range of said target device and when said target device goes beyond said predetermined second range.

6. A device as recited in claim 4, wherein said monitor transmission circuit comprises:

a receiver for receiving electric field related signals generated and transmitted by said target device;

transmission-reception synchronization circuit;

comparator circuit;

trigger circuit;

electronic switch circuit; and alarm circuit.

7. An electronic target monitoring system, said system comprising:

a target device adapted for attachment to a target person comprising a target transmission circuit, circuit having sensors that transmit a detectable signal when the target device extends beyond a predetermined first range or when a predetermined device comes within a predetermined second range of said target device; and a monitoring device having a means for determining when said predetermined device comes within said predetermined first range of said target device and when said target device goes beyond said predetermined second range, said monitoring device comprising a receiver for receiving electric field related signals generated and transmitted by said target device, transmission-reception synchronization circuit, comparator circuit, trigger circuit, electronic switch circuit and alarm circuit.

8. A device as recited in claim 7, wherein said target device comprises:

at least one means for attaching said target device to a person;

antenna for receiving and transmitting signals;

means for monitoring power;

sensor means that detects when said predetermined device comes within said predetermined first range of said target device and when said target device goes beyond said predetermined second range; and means for communicating to said monitoring device when said predetermined device comes within said predetermined first range of said target device and when said target device goes beyond said predetermined second range.

9. A device as recited in claim 7, wherein said target transmission circuit comprises:

means for generating an electric field;

sensor circuit;

oscillator stage;

message decoder circuit;

digital receiver of codified signal;

trigger circuit;

logic digital circuit;

alarm circuit;

output stage; and transmitter.

* * * * *